United States Patent [19]

Oki et al.

[11] 4,409,072

[45] Oct. 11, 1983

[54] METHOD OF COLLECTING LEAD FROM ASHES CONTAINING LEAD COMPOUNDS

[75] Inventors: Takeo Oki, Tsushima; Isao Hiraki, Sakai, both of Japan

[73] Assignee: Osaka Lead Refinery Co., Ltd., Osaka, Japan

[21] Appl. No.: 439,820

[22] Filed: Nov. 8, 1982

Related U.S. Application Data

[63] Continuation-in-part of Ser. No. 316,827, Oct. 30, 1981, abandoned, which is a continuation-in-part of Ser. No. 207,198, Nov. 14, 1980, abandoned.

[30] Foreign Application Priority Data

Apr. 21, 1979 [JP] Japan ..... 54-51032

[51] Int. Cl.[3] ..... C25B 1/00; C25R 1/18

[52] U.S. Cl. ..... 204/57; 204/114

[58] Field of Search ..... 204/116, 57

[56] References Cited

U.S. PATENT DOCUMENTS 2,846,378 8/1958 Hoffmann ..... 204/57

FOREIGN PATENT DOCUMENTS 55-141586 4/1979 Japan ..... 204/116

*Primary Examiner*—R. L. Andrews

*Attorney, Agent, or Firm*—Armstrong, Nikaido, Marmelstein & Kubovcik

[57] ABSTRACT

A method of electrolytically collecting lead from ashes containing lead compounds, comprising the steps of adding the ashes to an aqueous solution of caustic soda, and subjecting the mixture to electrolysis in two stages, i.e., preliminary electrolysis and stationary electrolysis.

1 Claim, No Drawings

METHOD OF COLLECTING LEAD FROM ASHES CONTAINING LEAD COMPOUNDS

This is a continuation-in-part of application Ser. No. 316,827, filed on Oct. 30, 1981, now abandoned, which is a continuation-in-part of application Ser. No. 207,198, filed on Nov. 14, 1980, now abandoned.

BACKGROUND OF THE INVENTION

The present invention relates to a method of electrolytically collecting lead from ashes which are produced in the smelting of lead scrap, lead slug, the pole plates of exhausted storage batteries, etc., in a smelting furnace such as a reverberating furnace, revolving furnace or vertical furnace.

Generally, these ashes are in the form of impalpable powder and contain lead compounds such as lead sulfide, lead oxide and lead sulfate. Elements such as antimony, arsenic, zinc, copper and tin are also contained in minute quantities in the form of simple substances or compounds. The ashes are assumed to be formed by the volatilization of lead or lead compounds occurring in a high-temperature atmosphere within the furnace. The lead content of these ashes amounts to about 70% or more by weight in dry measure. To make full use of resources, therefore, efficient collection of lead from the ashes is a mtter of great importance.

Various methods of treating the ashes have been proposed. As a typical one of the conventional methods, the ashes are mixed with lead ore, lead scrap, lead slug, or the pole plates of exhausted storage batteries or, in the alternative, the ashes are granulated and blended with a solvent, after which they are repeatedly smelted. Although these conventional methods do not require any complicated operation, the collection efficiency is extremely low and requires treating of waste gas and slag so as not to cause pollution problems.

SUMMARY OF THE INVENTION

It is an object of the present invention to provide a method of electrolytically collecting lead from the ashes which obviates the above-mentioned disadvantage and which does not cause any pollution problem.

According to the present invention, the ashes are added to an aqueous solution of caustic soda and the mixture is electrolyzed in two stages, i.e., preliminary electrolysis and stationary electrolysis, to deposit dense lead metal at the cathode and compact lead peroxide at the anode.

With the above-described objects in view, the present invention will be more clearly understood from the following detailed description.

DETAILED DESCRIPTION OF THE INVENTION

The present inventors have discovered that if electrolysis is carried out in a single stage, for example, only by stationary electrolysis, the material of the anode will melt out into the electrolyte and the coating of lead peroxide will peel off. However, the present inventors have discovered that if electrolysis is performed in two stages, no such problems occur, and that lead peroxide satisfactorily forms on the coating of lead peroxide of the anode.

The present invention takes advantage of the facts that lead oxide and lead sulfate, which are the principal ingredients of ashes left in a lead smelting furnace, are readily soluble in an aqueous solution of caustic soda and that lead sulfide, which is generally considered to be insoluble, can also be dissolved by interaction between the electrodes.

The ashes are added to an aqueous solution of caustic soda. The concentration of caustic soda in the aqueous solution used should preferably be 5 to 20% by weight. If it is lower than 5%, only a small quantity of the ashes will be dissolved in the aqueous solution. If it is higher than 20%, the aqueous solution will be so viscous as to be detrimental to the work efficiency and safety.

As the anode plate, a lead or iron plate coated with lead or a lead alloy by hot dipping is used. The cathode plate may be a lead or iron plate not coated or coated with lead or a lead alloy by hot dipping.

The electrolysis is carried out in two stages, i.e., preliminary electrolysis and stationary electrolysis. At the preliminary or first stage of electrolysis, the electrolyte is kept at a standstill or stagnant, that is, with no bubbling or stirring of the electrolyte, which prevents the lead from dissolving the anode. Also, at the preliminary stage of electrolysis, a high current density is used which is several times that used in the stationary stage of electrolysis to cause compact lead oxide to deposit at the anode. The preliminary stage is preferably continued for 10–30 minutes.

In the stationary stage of electrolysis, the electrolyte is stirred sufficiently for further depositing of compact lead peroxide at the anode.

The temperature of the aqueous solution under electrolysis should be preferably kept within a range between room temperature and approximately 80° C. throughout the entire electrolyiss. If it is higher than 80° C., evaporation of water from the bath will be excessive and cause various trouble.

Although the higher the current density is, the better; it should be preferably lower than 200 mA/cm$^2$ because excessively high current density would cause the generation of gas. The current density may be changed either by the adjustment of load current or by changing the surface area of the electrodes. The surface area of the electrodes can be changed by changing the form of the pole plates.

Ashes may be thrown into the electrolytic bath and subjected to electrolysis either bathwise or continuously. Continuous operation is more preferable for treating a large quantity of ashes on an industrial scale, of course.

The following examples demonstrate preferred conditions for the method of the present invention. Unless otherwise stated, quantities are expressed as percent by weight.

EXAMPLE I (1) Sample Ashes a. Composition

Lead: 78.9% Sulfur: 6.2% Water: 1.9%

Antimony, tin, arsenic, copper, zinc, aluminum, silver and bismuth: In small quantities b. Particle Size small enough to pass through a 325-mesh screen.

(2) Conditions of Electrolysis

As shown in Table 1.

TABLE 1

| Exm. No. | Electrolyte NaOH content | Temp. °C. | Amount of ashes added g/l | Current density mA/cm² preliminary | stationary |
|---|---|---|---|---|---|
| 1 | 5 wt % | 50 | 14.1 | 170 | 50 |
| 2 | 10 | 50 | 26.7 | 150 | 35 |
| 3 | 10 | 20 | 25.6 | 180 | 50 |
| 4 | 20 | 50 | 33.7 | 190 | 100 |

(3) Results
a. Current Efficiency
107.8% at cathode
73.5% at anode
b. Content of impurities in the lead deposited on the cathode
Antimony: Less than 0.1%
Tin, arsenic and copper: Less than 0.01% each
c. Content of the impurities in the lead peroxide deposited on the anode
An X-ray diffractiometry revealed that the deposit of lead peroxide formed on the anode was of $\alpha$ type.
Antimony: Less than 0.2%
Tin, arsenic and copper: Less than 0.01% each

EXAMPLE II (1) Sample Ashes
The same ashes as used in EXAMPLE I.
(2) Conditions of Electrolysis
As shown in Table 1.
(3) Results
a. Current Efficiency
102.4% at cathode
98.8% at anode
b. Results of Analysis of the Deposits
The same as in EXAMPLE I.

EXAMPLE III (1) Sample Ashes
The same ashes as used in EXAMPLE I.
(2) Conditions of Electrolysis
As shown in Table 1.
(3) Results
a. Current Efficiency
99.4% at cathode
71.3% at anode
b. Results of Analysis of the Deposits
The same as in EXAMPLE I.

EXAMPLE IV (1) Sample Ashes
The same ashes as used in EXAMPLE I.
(2) Conditions of Electrolysis
As shown in Table 1.
(3) Results
a. Current Efficiency
95.2% at cathode
51.6% at anode
b. Results of Analysis of the Deposits
The same as in EXAMPLE I.

The above-described examples reveal that both the lead formed on the cathode and the lead peroxide formed on the anode are of high purity and that the current efficienty is 1.5 to 2 times as high as in the conventional methods.

Sodium sulfate, which is a secondary product formed in the course of electrolysis, can be easily crystallized and separated by cooling the bath. Since this secondary product is innoxious, there is no necessity for taking measures against environmental pollution.

No harmful objects such as oxides of sulfur are formed throughout electrolysis in the method according to the present invention.

While preferred embodiments of the present invention have been disclosed, it is to be understood that it is described by way of example only and not in a limiting sense, and the scope of the present invention is determined by the following claim.

What we claim is:

1. A method of electrolytically collecting lead from ashes containing lead compounds, comprising:
adding the ashes to an aqueous solution containing 5 to 20 weight percent of caustic soda,
depositing lead at the cathode and lead peroxide at the anode by subjecting the solution to electrolysis in two stage, first at a current density of 120 to 200 mA/cm² without stirring the solution and then at a current density of 20 to 100 mA/cm² with stirring, the temperature being between room temperature and 80° C. in both stages, said cathode being a lead or iron plate not coated or coated with lead or a lead alloy and said anode being a lead or iron plate coated with lead or a lead alloy.

* * * * *